US010159621B1

(12) United States Patent
Gomez

(10) Patent No.: US 10,159,621 B1
(45) **Date of Patent: *Dec. 25, 2018**

(54) LIP SUCTION DEVICE AND RELATED METHODS

(71) Applicant: FULLIPS, LLC, Paradise Valley, AZ (US)

(72) Inventor: Linda M. Gomez, Paradise Valley, AZ (US)

(73) Assignee: Fullips, LLC, Paradise Valley, AZ (US)

( * ) Notice: Subject to any disclaimer, the term of this patent is extended or adjusted under 35 U.S.C. 154(b) by 12 days.

This patent is subject to a terminal disclaimer.

(21) Appl. No.: 14/512,273

(22) Filed: Oct. 10, 2014

Related U.S. Application Data

(63) Continuation of application No. 13/480,190, filed on May 24, 2012, now Pat. No. 8,858,472, which is a continuation-in-part of application No. 12/474,920, filed on May 29, 2009.

(51) Int. Cl.
*A61H 7/00* (2006.01)

(52) U.S. Cl.
CPC ..... *A61H 7/001* (2013.01)

(58) Field of Classification Search
CPC ..... A61F 5/566; A61F 5/56; A61H 9/005; A61H 9/0057; A61H 7/008; A61H 7/00; A61H 15/0085; A61H 2205/082; A61H 7/001; A61M 1/08; A61M 1/0011; A61M 1/0066
See application file for complete search history.

(56) References Cited

U.S. PATENT DOCUMENTS

| | | | | |
|---|---|---|---|---|
| 931,102 A | | 8/1909 | Walter | |
| 1,882,040 A | | 10/1932 | Roehm | |
| 1,994,781 A | * | 3/1935 | Mutch | A61H 9/005 601/6 |
| 2,187,560 A | | 1/1940 | Reilly | |
| 2,189,116 A | * | 2/1940 | Niemiec | A61H 9/005 601/6 |
| 2,218,443 A | | 10/1940 | Tweddle | |

(Continued)

FOREIGN PATENT DOCUMENTS

| | | |
|---|---|---|
| CN | 2254743 Y | 5/1997 |
| DE | 19522416 A1 | 1/1997 |

(Continued)

*Primary Examiner* — Ophelia A Hawthorne
(74) *Attorney, Agent, or Firm* — IPTechLaw

(57) ABSTRACT

A lip suction device. A rigid hollow form has an opening at a first end of the rigid hollow form and a cavity therein extending from the first end to a second end of the rigid hollow form. The rigid hollow form has an outer surface and a thickness at the opening between the outer surface and a surface of the cavity. The opening has an edge with a rounded shape, across the thickness at the opening, which is configured to form a substantially air-tight seal between a user's face and the edge when the rigid hollow form is pressed against the user's face near the user's lips. The rigid hollow form is configured so that when the user draws air into the user's mouth after forming a substantially air-tight seal, the user's lips are drawn into the rigid hollow form towards the second end of the rigid hollow form.

9 Claims, 5 Drawing Sheets

(56) References Cited

U.S. PATENT DOCUMENTS

| | | | | |
|---|---|---|---|---|
| 3,118,667 | A * | 1/1964 | Barons | A63B 21/065 482/11 |
| 3,236,231 | A | 2/1966 | Schneider et al. | |
| 3,396,720 | A | 8/1968 | Ohkubo | |
| 3,742,607 | A | 7/1973 | Johnson | |
| 5,282,815 | A * | 2/1994 | Kabbara | A61F 9/013 128/898 |
| 5,377,701 | A | 1/1995 | Fang | |
| 5,871,456 | A | 2/1999 | Armstrong et al. | |
| 6,309,364 | B1 | 10/2001 | Cathaud et al. | |
| 7,131,441 | B1 | 11/2006 | Keller et al. | |
| 7,201,630 | B2 | 4/2007 | Cope | |
| 8,858,472 | B2 * | 10/2014 | Gomez | A61H 9/0057 601/6 |
| 2002/0117178 | A1 | 8/2002 | Dort | |
| 2004/0073144 | A1 | 4/2004 | Carava | |
| 2005/0267386 | A1 | 12/2005 | Copelan | |
| 2009/0013993 | A1 | 1/2009 | Bird et al. | |

FOREIGN PATENT DOCUMENTS

| | | | |
|---|---|---|---|
| GB | 191414989 | A | 6/1914 |
| GB | 169052 | A | 9/1921 |
| GB | 551933 | | 3/1943 |
| JP | 9098835 | A | 4/1997 |
| JP | 11196936 | A | 7/1999 |

* cited by examiner

LIP SUCTION DEVICE AND RELATED METHODS

CROSS REFERENCE TO RELATED APPLICATIONS

This application is a continuation application of the earlier U.S. Utility patent application Ser. No. 13/480,190, filed May 24, 2012, now U.S. Pat. No. 8,858,472, issued Oct. 14, 2014, titled "Lip Suction Device and Related Methods," naming as first inventor Linda M. Gomez, which is a continuation-in-part application of the earlier U.S. Utility patent application Ser. No. 12/474,920, filed May 29, 2009, titled "Full Lips Self Suction Device and Process Therefore," naming as first inventor Linda M. Gomez, now abandoned, the disclosures of each of which are hereby incorporated entirely herein by reference.

BACKGROUND

1. Technical Field

Aspects of this document relate generally to devices and methods to enhance human lips.

2. Background Art

Methods exist in the art to enhance human lips, such as soft tissue augmentation and injected treatments.

SUMMARY

Implementations of lip suction devices may include: a rigid hollow form having an opening at a first end of the rigid hollow form and a cavity therein extending from the first end to a second end of the rigid hollow form, the rigid hollow form having an outer surface and having a thickness at the opening between the outer surface and a surface of the cavity; and wherein the opening has an edge wherein the edge includes a rounded shape across the thickness at the opening; wherein the rounded shape of the edge is configured to form a substantially air-tight seal between a user's face and the edge when the rigid hollow form is pressed against the user's face near the user's lips; and wherein the rigid hollow form is configured so that when the user draws air into the user's mouth after forming the substantially air-tight seal, the user's lips are drawn into the rigid hollow form towards the second end of the rigid hollow form.

Implementations of lip suction devices may include one, all, or any of the following:

The rounded shape may be circular.

The rigid hollow form may have a cross section having a shape of one of a circle and a rectangle with two opposing half-circle ends.

The rigid hollow form may have a shape of a squat cylinder with a sidewall and a bottom covering the second end.

The opening may have a shape of a circle.

The opening may have a shape of a rectangle with two opposing half circle ends.

The rigid hollow form may have a first outer diameter and a second outer diameter, the first outer diameter being closer to the first end than the second outer diameter, and the first outer diameter being larger than the second outer diameter.

The outer surface may include a ribbed section.

The rigid hollow form may have a ledge at the surface of the cavity.

Implementations of lip suction devices may include: a rigid hollow form having an opening at a first end of the rigid hollow form and a cavity therein extending from the first end to a second end of the rigid hollow form, the rigid hollow form including an outer surface and having a thickness at the opening between the outer surface and a surface of the cavity; and wherein the opening includes an edge wherein the edge includes a rounded shape across the thickness at the opening.

Implementations of lip suction devices may include one, all, or any of the following:

The rounded shape may be circular.

The rigid hollow form may include a cross section comprising a shape of one of a circle and a rectangle with two opposing half-circle ends.

The opening may include a shape of a circle.

The opening may include a shape of a rectangle with two opposing half circle ends.

The rigid hollow form may include a first outer diameter and a second outer diameter, the first outer diameter being closer to the first end than the second outer diameter, and the first outer diameter being larger than the second outer diameter.

The outer surface may include a ribbed section.

The rigid hollow form may include a ledge at the surface of the cavity.

Implementations of lip suction devices may include: a rigid hollow form having an opening at a first end of the rigid hollow form and a cavity therein extending from the first end to a second end of the rigid hollow form; a mount releasably couplable to the rigid hollow form at a surface of the cavity, the mount having a mount edge defining a mount opening, the mount forming a substantially air tight seal between the mount and the rigid hollow form; wherein the mount edge is configured to form a substantially air-tight seal between a user's face and the mount edge when the mount is pressed against the user's face near the user's lips; and wherein the mount and rigid hollow form are configured so that when the user draws air into the user's mouth after forming the two substantially air-tight seals, at least a portion of the user's lips are drawn through the mount opening towards the second end of the rigid hollow form.

Implementations of lip suction devices may include one, all, or any of the following:

The rigid hollow form may include a cross section having a shape of one of a circle and a rectangle with two opposing half-circle ends.

The mount opening may have a shape of one of a circle, a rectangle with two opposing half circle ends, and a heart.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

Figure 1A:
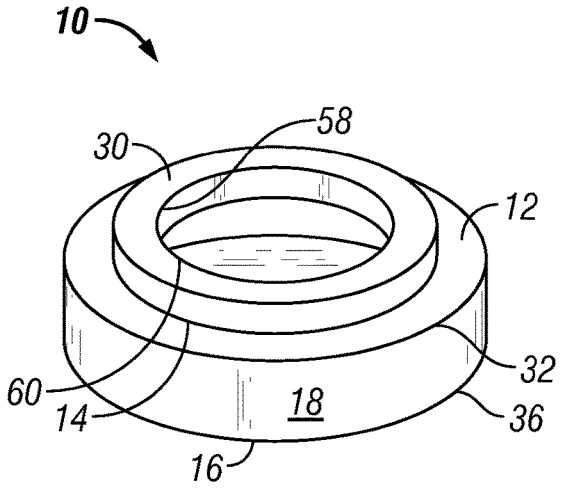
FIG. 1A is a perspective view of an implementation of a lip suction device.
Figure 1B:
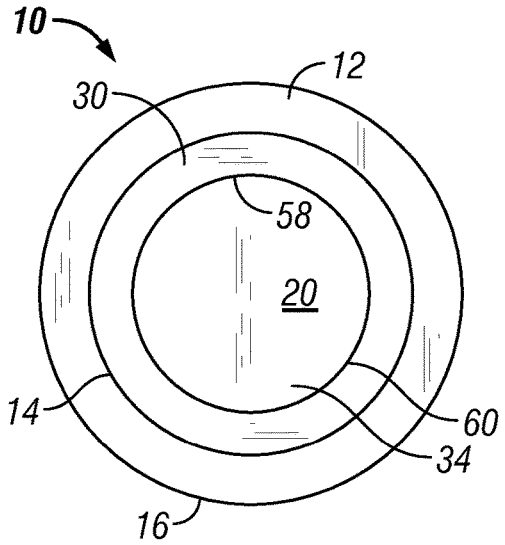
FIG. 1B is a top view of the lip suction device of FIG. 1A.
Figure 2A:
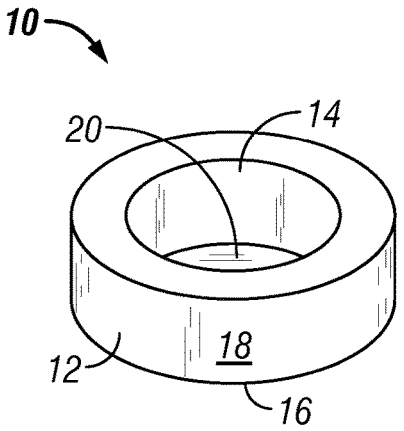
FIG. 2A is a perspective view of an implementation of a lip suction device.
Figure 2B:
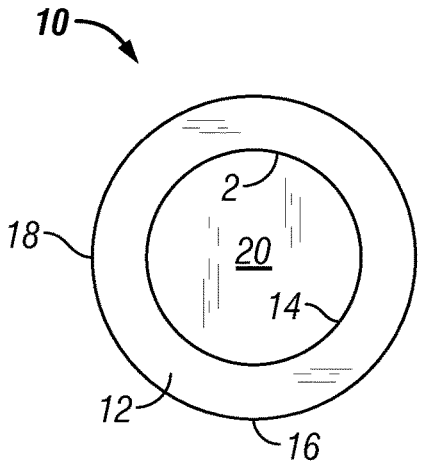
FIG. 2B is a top view of the lip suction device of FIG. 2A.

This disclosure, its aspects and implementations, are not limited to the specific components or assembly procedures disclosed herein. Many additional components and assembly procedures known in the art consistent with the intended lip suction devices and related methods and/or assembly procedures for lip suction devices will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such lip suction devices and implementing components and related methods, consistent with the intended operation.

In implementations a self-suctioning lip enhancement device (lip suction device) (device) 10 includes a hollow form 12 having an opening 14 therein. In implementations the hollow form 12 is a rigid hollow form 12. In implementations, as illustrated in FIGS. 1A to 10B, the rigid hollow form 12 may have a shape of a squat cylinder 16 having a sidewall 18 and a bottom 20 at one end with opening 14 at the other end thereof. In addition, the cylinder length can be varied as shown by comparing FIGS. 1A-10B.

Figure 5A:
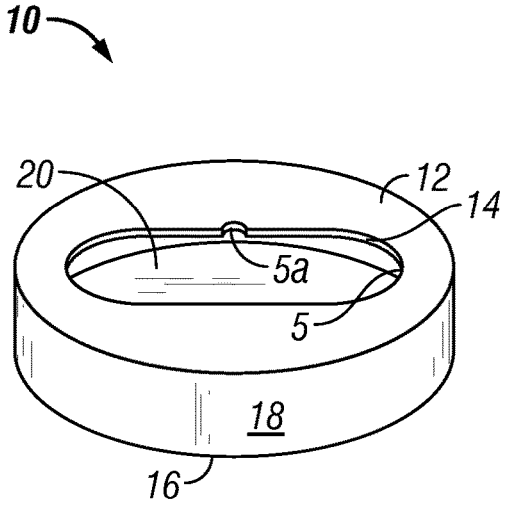
FIG. 5A is a perspective view of an implementation of a lip suction device.
Figure 5B:
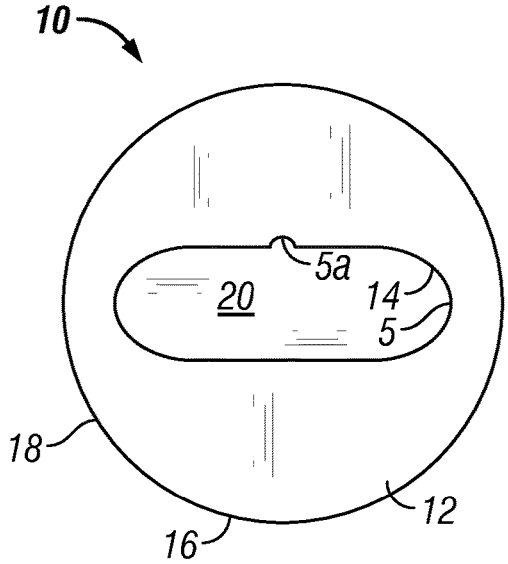
FIG. 5B is a top view of the lip suction device of FIG. 5A.

In implementations of use, as seen in FIGS. 5A-5C, a person (user) 22 places his/her lips (user's lips) 26 over opening 14 and creates a substantially air-tight seal using his/her mouth 24. As seen in FIG. 5B, the user 22 draws air into his/her mouth 24 thereby lowering the air pressure inside the device 10 which acts to pull the tissue of the lips 26 therein. The user 22 waits for a period of time, in some implementations a few minutes, before releasing the seal and removing the device 10 as shown in FIG. 5C. This suction action on lips 26 creates temporarily fuller lips 26 as shown in FIG. 5C. In implementations the effect may last a few hours with the lips 26 returning to normal thereafter, with no lasting aftereffects.

Opening 14 can be a variety of shapes as shown in FIGS. 1A-10B. FIGS. 1A-2B, 4A-4B and 9A-9B show circular shaped openings 14. Opening 14 of FIGS. 3A-3B has the shape of a rectangle with rounded corners. Opening 5 (opening 14) of FIGS. 5A-5B, opening 7 (opening 14) of FIGS. 6A-6B, and openings 14 of FIGS. 8A-8B and 10A-10B have the shape of a rectangle with two opposing half-circle ends. Opening 5 (opening 14) additionally has a cutout 5*a* centered on one long side of opening 5 (opening 14) in FIGS. 5A and 5B. Opening 5 (opening 14) may create the effect of full lips 26 with an enhanced effect on the middle of the upper lip 26.

In implementations, as in FIGS. 1A through 1B and 3A-4B, the rigid hollow form 12 includes an opening 14 at a first end 32 of the rigid hollow form 12 and a cavity 34 therein extending from the first end 32 to a second end 36 of the rigid hollow form 12, and a mount 30 releasably couplable to the rigid hollow form 12 at a surface 42 of the cavity 34. The mount 30 in implementations is coupled to the rigid hollow form 12 through the opening 14. The mount 30 includes a mount edge 58 defining a mount opening 60 and the mount 30 forms a substantially air-tight seal between the mount 30 and the rigid hollow form 12, as described herein. The mount edge 58 is configured to form a substantially air-tight seal between a user's face and the mount edge 58 when the mount 30 is pressed against the user's face near the user's lips 26. The mount 30 and rigid hollow form 12 are configured so that when the user draws air into the user's mouth 24 after forming the two substantially air-tight seals, at least a portion of the user's lips 26 are drawn through the mount opening 60 towards the second end 36 of the rigid hollow form 12.

Figure 3A:
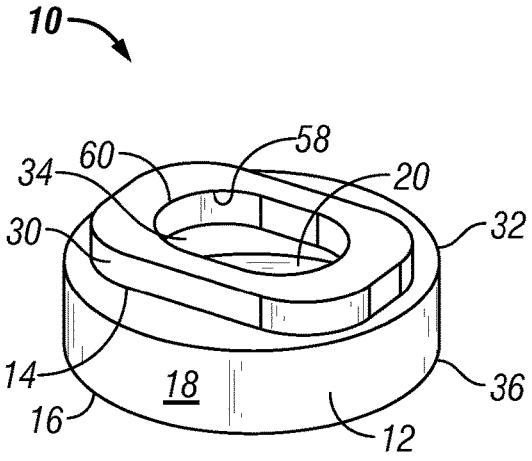
FIG. 3A is a perspective view of an implementation of a lip suction device.
Figure 3B:
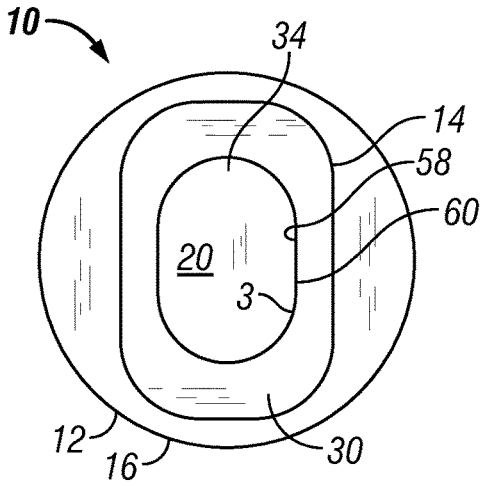
FIG. 3B is a top view of the lip suction device of FIG. 3A.
Figure 4A:
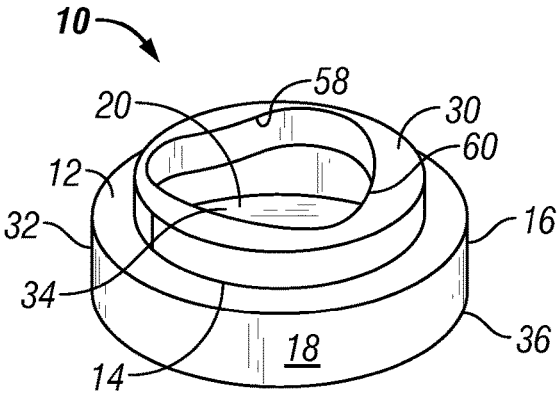
FIG. 4A is a perspective view of an implementation of a lip suction device.
Figure 4B:
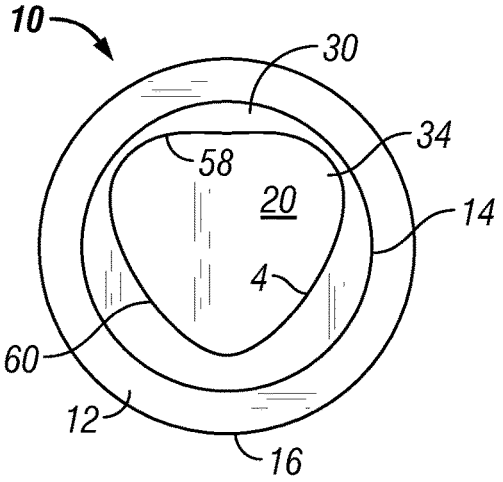
FIG. 4B is a top view of the lip suction device of FIG. 4A.

The mount opening 3 (mount opening 60) in FIGS. 3A and 3B has a shape of a rectangle with two opposing half-circle ends, and creates the effect of symmetrical full lips 26 on the middle of the lips 26. The mount opening 60 of FIGS. 1A-1B has a circular shape. The mount opening 4 (mount opening 60) of FIGS. 4A-4B has a shape of a heart. In various implementations these shapes (rectangle with two opposing half-circle ends, circle, heart) are substantially parallel with the largest planar surface of the bottom 20.

Figure 6A:
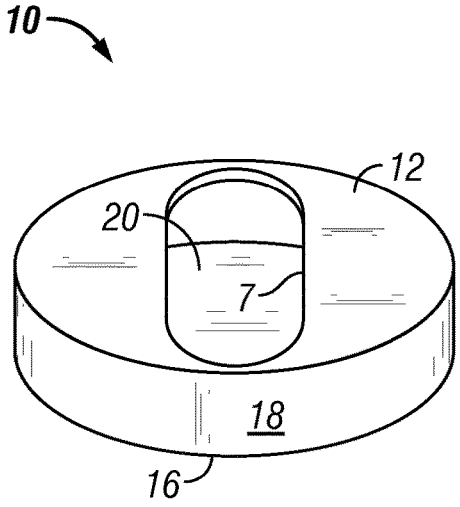
FIG. 6A is a perspective view of an implementation of a lip suction device.
Figure 6B:
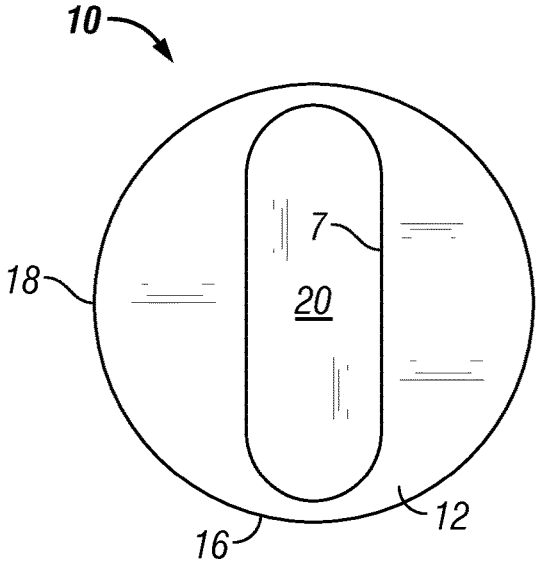
FIG. 6B is a top view of the lip suction device of FIG. 6A.
Figure 7A:
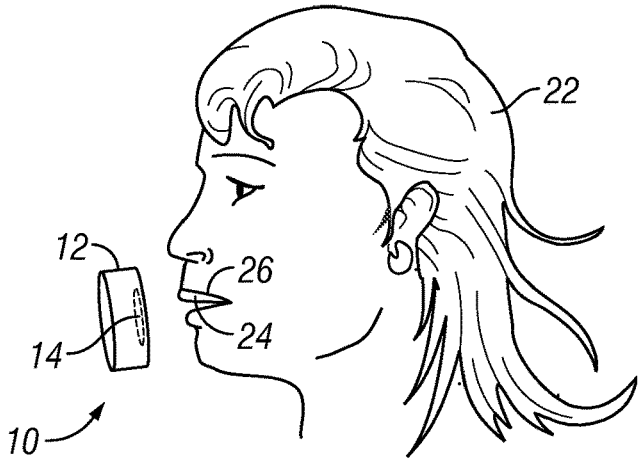
FIG. 7A is a side view of a user and an implementation of a lip suction device.
Figure 7B:
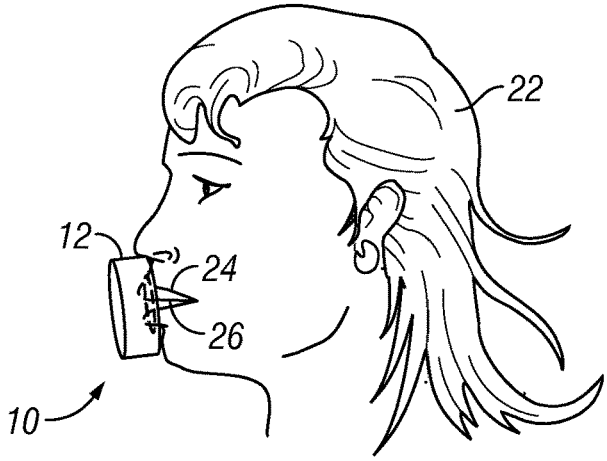
FIG. 7B is a side view of the user of FIG. 7A using the lip suction device of FIG. 7A.
Figure 7C:
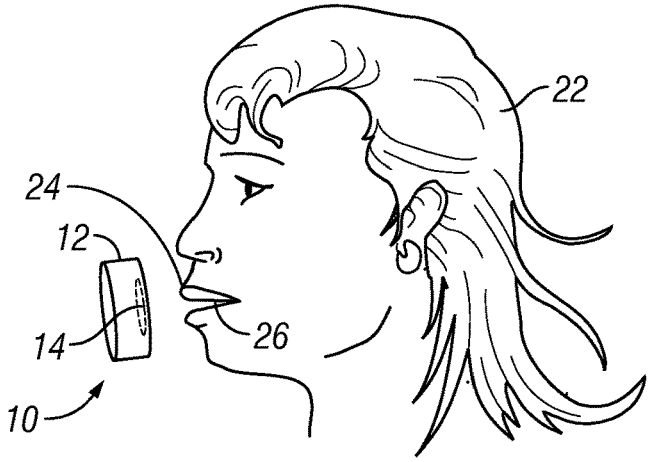
FIG. 7C is a side view of the user of FIG. 7A after using the lip suction device of FIG. 7A.

In implementations the openings 14 and/or mount openings 60 of FIGS. 3A-3B, 5A-6B, 8A-8B and 10A-10B may produce an additional enhancing effect on the user's lips 26 when the long axis of the opening 14 or mount opening 60 is oriented vertically, as shown in FIGS. 6A and 6B with respect to opening 7 (opening 14). In implementations of use, heart-shaped opening 4 (mount opening 60) in FIGS. 4A and 4B may create a fuller upper lip 26.

Those skilled in the art will recognize that many shapes are possible. In general, the narrow shapes create a centered fullness in the lips 26 while wider openings 14 (or mount openings 60) widen the entire lips 26 as desired. In implementations opening 14 is sealable by the mouth 24 of a user to allow the self-suctioning action. In addition, hollow form 12 in implementations is small enough that a user can get a sufficient low air pressure to create the effect of full lips 26. Further, hollow form 12 in implementations is air tight whereby once the user seals the opening 14 or mount opening 60, as the case may be, reduced air pressure can be created within hollow form 12 by simply drawing air into the user's mouth 24 through opening 14 and/or mount opening 60, as the case may be.

In the embodiments of FIGS. 1A, 1B, 3A, 3B, 4A and 4B, the shape is provided by a mount 30 which is temporarily affixed to hollow form 12. In implementations a mount 30 could cover a circular opening 2 (opening 14) of the rigid hollow form 12 of FIGS. 2A-2B, thereby replacing the circular opening 2 (opening 14) with shapes as desired, to form the implementations shown in FIGS. 1A-1B and 4A-4B. In implementations a mount 30 could cover a differently-shaped opening 14, such as the opening 14 of the implementation of FIGS. 3A-3B, wherein the opening 14 has a shape of a rectangle with rounded corners. In other implementations the lip suction devices 10 of FIGS. 1A-1B and 3A-4B could be formed of one contiguous piece whereby the mount 30 and rigid hollow form 12 are a single contiguous piece and are not separate pieces releasably coupled to one another.

Referring now to FIGS. 1A-1B, 3A-4B and 8A-10B, in implementations the rigid hollow form 12 has a first end 32 and a second end 36, and a cavity 34 therein extending from an opening 14 at the first end 32 to the second end 36, and the bottom 20 is at the second end 36. The rigid hollow form 12 has an outer surface 38 and has a thickness at the opening 14 between the outer surface 38 and a surface 42 of the cavity 34. In implementations this thickness is measured as the distance from the outer surface 38 to a surface 42 of the cavity 34 along a direction substantially parallel with the largest planar surface of the bottom 20.

In implementations the opening 14 has an edge 44. In implementations the edge 44 includes a rounded shape 46 across the thickness at the opening 14. The rounded shape 46 is configured to form a substantially air-tight seal between the user's face and the edge 44 when the rigid hollow form 12 is pressed against a user's face near the user's lips 26 with sufficient force. The rigid hollow form 12 in implementations is configured so that when the user draws air into the user's mouth 24 after forming the substantially air-tight seal, the user's lips 26 are drawn into the rigid hollow form 12 towards the second end 36 of the rigid hollow form 12.

In implementations, as shown in FIGS. 8A-10B, the rounded shape 46 is circular. In other implementations the rounded shape 46 may have an oval shape, a shape of a rectangle with rounded edges, and so forth.

In implementations, as in FIGS. 1A-7C and 9A-9B, the rigid hollow form 12 may have a cross section having a shape of a circle. In implementations this cross section is substantially parallel with the largest planar surface of the bottom 20. In implementations, as in FIGS. 5A-6B, 8A-8B and 10A-10B, the rigid hollow form 12 may have a cross section having a shape of a rectangle with two opposing half-circle ends. In implementations this cross section is substantially parallel with the largest planar surface of the bottom 20.

In implementations, as in FIGS. 1A-2B, 4A-4B, 7A-7C and 9A-9B, the opening 14 has a circular shape. In implementations, as in FIGS. 3A-3B, the opening 14 has a shape of a rectangle with rounded corners. In implementations, as in FIGS. 5A-6B, 8A-8B and 10A-10B, the opening 14 has a shape of a rectangle with two opposing half-circle ends. In implementations, as in FIGS. 5A-5B, the opening 14 has a shape of a rectangle with two opposing half-circle ends, with a cutout 5*a* substantially in the center of one of the sides of the opening 14. In implementations these shapes (circular, rectangle with rounded corners, rectangle with two opposing half-circle ends, rectangle with two opposing half-circle ends with a cutout) are substantially parallel with the largest planar surface of the bottom 20.

In implementations, as shown in FIGS. 8A-10B, the rigid hollow form 12 has a first outer diameter and a second outer diameter, the first outer diameter being closer to the first end 32 than the second outer diameter (or, in other words, the distance between the first outer diameter and the first end 32 is smaller than the distance between the second outer diameter and the first end 32), and the first outer diameter being larger than the second outer diameter. In implementations the first outer diameter and/or the second outer diameter are/is substantially parallel with the largest planar surface of the bottom 20. In implementations, as shown in FIGS. 8A-10B, the rigid hollow form 12 has a first inner diameter and a second inner diameter, the first inner diameter being closer to the first end 32 than the second inner diameter (or, in other words, the distance between the first inner diameter and the first end 32 is smaller than the distance between the second inner diameter and the first end 32), and the first inner diameter being larger than the second inner diameter. In implementations, as shown in FIGS. 5A-6B, the rigid hollow form 12 has a first inner diameter and a second inner diameter, the first inner diameter being closer to the first end 32 than the second inner diameter (or, in other words, the distance between the first inner diameter and the first end 32 is smaller than the distance between the second inner diameter and the first end 32), and the first inner diameter being smaller than the second inner diameter. In implementations, including the implementations of FIGS. 5A-6A and 8A-10B, the first inner diameter and second inner diameter are substantially parallel with the largest planar surface of the bottom 20.

In implementations, as shown in FIGS. 1A-1B and 3A-4B, the mount 30 has an inner diameter and an outer diameter, and the rigid hollow form 12 has an inner diameter and an outer diameter, and the outer diameter of the mount 30 is smaller than the outer diameter of the rigid hollow form 12, and the inner diameter of the mount 30 is also smaller than the inner diameter of the rigid hollow form 12. In implementations, the outer diameter of the mount 30 and inner diameter of the rigid hollow form 12 are substantially the same size, and this assists to form a substantially air-tight seal between the mount 30 and rigid hollow form 12 when the two are pressed together. Other items and mechanisms could be implemented to assist in forming a substantially air-tight seal between the mount 30 and rigid hollow form 12, such as, by non-limiting example, an O-ring or other polymeric seal. In implementations, as in those shown in FIGS. 1A-1B and 3A-4B, the inner diameter and outer diameter of the mount 30, and inner diameter and outer diameter of the rigid hollow form 12, are substantially parallel with the largest planar surface of the bottom 20.

Figure 8A:
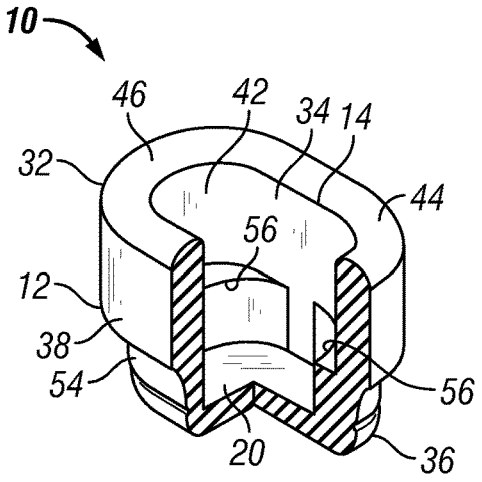
FIG. 8A is a cutaway perspective view of an implementation of a lip suction device.
Figure 8B:
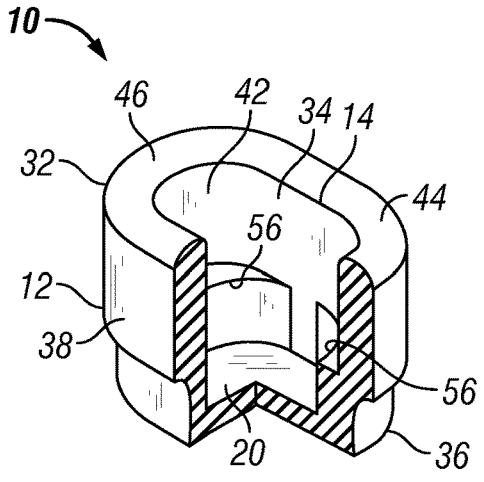
FIG. 8B is a cutaway perspective view of an implementation of a lip suction device.
Figure 9A:
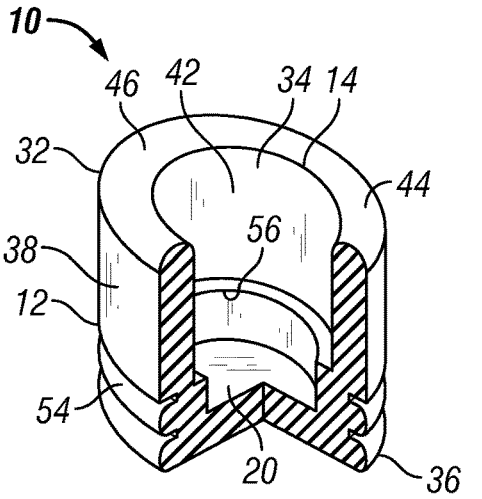
FIG. 9A is a cutaway perspective view of an implementation of a lip suction device.
Figure 9B:
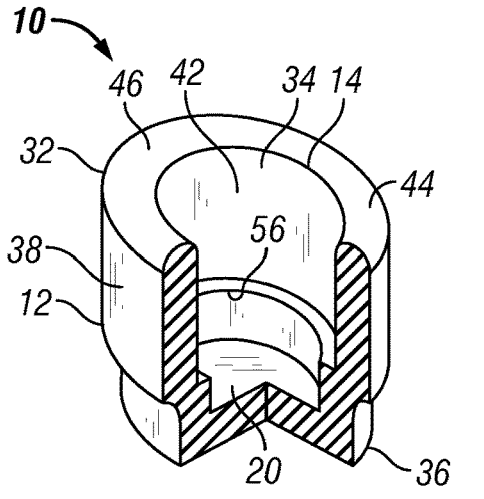
FIG. 9B is a cutaway perspective view of an implementation of a lip suction device.
Figure 10A:
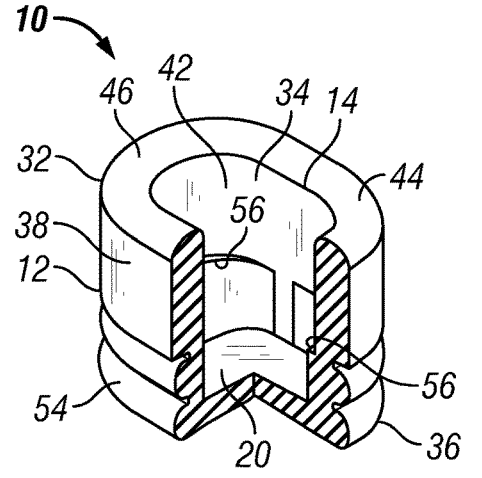
FIG. 10A is a cutaway perspective view of an implementation of a lip suction device.
Figure 10B:
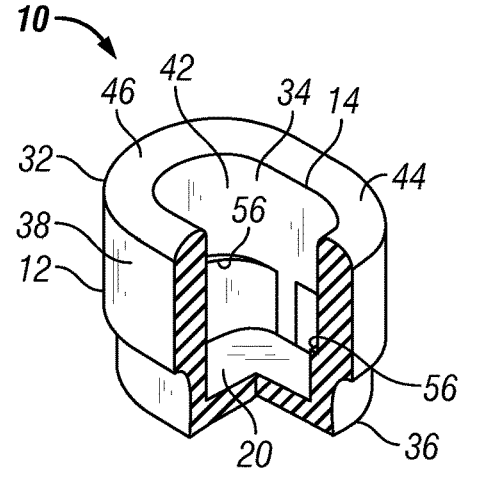
FIG. 10B is a cutaway perspective view of an implementation of a lip suction device.

In implementations, as shown in FIGS. 8A, 9A and 10A, the rigid hollow form 12 includes a ribbed section 54 on the outer surface 38. In implementations, as in FIG. 8A, the ribbed section 54 includes ribs of varying outer diameters, the outer diameters substantially parallel with the largest planar surface of the bottom 20. In implementations, as in FIGS. 9A and 10A, the ribbed section 54 includes ribs of substantially equal outer diameters, the outer diameters substantially parallel with the largest planar surface of the bottom 20.

In implementations, as shown in FIGS. 8A-10B, the rigid hollow form 12 has a ledge 56 at the surface 42 of the cavity 34. In implementations the ledge 56 is substantially parallel with the largest planar surface of the bottom 20. In implementations, as in FIGS. 8A-8B and 10A-10B, the rigid hollow form 12 has multiple ledges 56. In implementations the ledge 56 at least partially couples a first inner diameter of the rigid hollow form 12 to a second inner diameter of the rigid hollow form 12. In implementations, as in FIGS. 9A-9B, the ledge 56 has a substantially constant thickness in a direction substantially parallel with the largest planar surface of the bottom 20. In implementations, as in FIGS.

8A-8B and 10A-10B, the ledge 56 has a varying thickness in a direction substantially parallel with the largest planar surface of the bottom 20.

In various implementations the rounded shape 46 at the edge 44 permits a user to use the lip suction device 10 without the device 10 forming lines on the user's face due to the pressure of the edge 44 or mount edge 58 against the skin during use. In implementations of use of a lip suction device 10 the edge 44 or mount edge 58, as the case may be, may be moistened with a fluid prior to forming a substantially air-tight seal between the edge 44 or mount edge 58 and the face of the user. The fluid in implementations may be, by non-limiting example, water. In implementations the edge 44 couples the outer surface 38 to the surface 42 of the cavity 34 and the entirety of the edge 44 is rounded.

Implementations of a lip suction device 10 may utilize implementations of a method of creating fuller lips, which may include one, all, or any of the following steps: moistening an edge 44 of a lip suction device 10; forming a substantially air-tight seal between a user's face and the edge 44 of a lip suction device 10 when the rigid hollow form 12 is pressed against the user's face near the user's lips 26; drawing air into the user's mouth 24 after forming the substantially air-tight seal; drawing the user's lips 26 into the rigid hollow form 12 towards the second end 36 of the rigid hollow form 12; and not forming a line on the user's face due to the pressure of the edge 44 against the user's face.

Implementations of a lip suction device 10 utilizing a mount 30 may utilize implementations of another method of creating fuller lips which may include one, all, or any of the following steps: coupling a mount 30 to the rigid hollow form 12 at a surface 42 of the cavity 34; moistening a mount edge 58 of the lip suction device 10; forming a substantially air-tight seal between the mount 30 and the rigid hollow form 12; forming a substantially air-tight seal between a user's face and the mount edge 58 by pressing the mount 30 against the user's face near the user's lips 26; drawing air into the user's mouth 24; drawing at least a portion of the user's lips 26 through the mount opening 60 towards the second end 36 of the rigid hollow form 12; and not forming a line on the user's face due to the pressure of the mount 30 against the user's face.

In implementations the use of a lip suction device 10 may make it easier to apply makeup, lipstick, liner and/or the like. In implementations this may be due to the lip suction device 10 adding definition to an area or portion of the lips or defining and area or portion of the lips to receive makeup, lipstick, liner and/or the like. Implementations of methods of use of a lip suction device 10 may include making the application of one of makeup, lipstick, lip liner, and the like easier.

In places where the description above refers to particular implementations of lip suction devices, it should be readily apparent that a number of modifications may be made without departing from the spirit thereof and that these implementations may be applied to other lip suction devices.

What is claimed is:

1. A lip suction device, consisting essentially of:

a rigid hollow form comprising an opening at a first end of the rigid hollow form and a cavity therein extending from the first end to a closed second end of the rigid hollow form, the rigid hollow form comprising an outer surface and comprising a thickness between the outer surface and a surface of the cavity;

wherein the opening comprises a rounded shape at the surface of the cavity extending across the thickness between the outer surface and the surface of the cavity.

2. The device of claim 1, wherein the rigid hollow form comprises only a single opening.

3. The device of claim 1, wherein the rounded shape is circular.

4. The device of claim 1, wherein the rigid hollow form comprises a cross section comprising a shape of one of a circle and a rectangle with two opposing half-circle ends.

5. The device of claim 1, wherein the opening comprises a shape of a circle.

6. The device of claim 1, wherein the opening comprises a shape of a rectangle with two opposing half circle ends.

7. The device of claim 1, wherein the rigid hollow form comprises a first outer diameter and a second outer diameter, the first outer diameter being closer to the first end than the second outer diameter, and the first outer diameter being larger than the second outer diameter.

8. The device of claim 1, wherein the outer surface comprises a ribbed section.

9. The device of claim 1, wherein the rigid hollow form comprises a ledge at the surface of the cavity.

* * * * *